United States Patent [19]

Mahar

[11] 4,274,923

[45] * Jun. 23, 1981

[54] AIR POLLUTION CONTROL METHOD AND APPARATUS FOR THE EXTRUSION AND QUENCHING OF COKE

[75] Inventor: Kevin D. Mahar, Buffalo, N.Y.

[73] Assignees: Republic Steel Corporation, Cleveland, Ohio; The Hanna Furnace Corporation, Buffalo, N.Y.

[ * ] Notice: The portion of the term of this patent subsequent to Sep. 13, 1995, has been disclaimed.

[21] Appl. No.: 13,960

[22] Filed: Feb. 22, 1979

[51] Int. Cl.[3] ..... C10B 39/12

[52] U.S. Cl. ..... 201/39; 202/230; 202/263

[58] Field of Search ..... 201/39; 202/230, 227, 202/229, 263

[56] References Cited

U.S. PATENT DOCUMENTS

| | | | |
|---|---|---|---|
| 3,766,018 | 10/1973 | Reichert | 202/263 |
| 3,959,083 | 5/1976 | Goedde et al. | 201/39 |
| 4,113,569 | 9/1978 | Mahar | 202/227 |
| 4,141,796 | 2/1979 | Clark et al. | 201/39 |

*Primary Examiner*—Norman Yudkoff

*Attorney, Agent, or Firm*—Hosier, Niro & Daleiden

[57] ABSTRACT

Method and apparatus for extruding incandescent coke from a coke oven and for quenching the coke prior to transport thereof from the point where extruded. The method and apparatus include enhanced air pollutant emission control characteristics. The apparatus includes an inverted, truncated-pyramid container cradled within the frame of a vehicle similar to that used to transport molten metal. Prior to coke extrusion the vehicle permits indexing of the container under the plane through which the extruded coke falls so as to receive all of such extruded coke. While indexed and immobile, the container is adapted to mate with a correspondingly indexed hood having emission control means adapted to be operable during both the extrusion and quenching of the coke at the indexed position of the container/hood. Use of the present invention, in comparison to the prior art, further minimizes the escape of uncleaned, air pollutant-emitting fume, both by virtue of combustion suppression and exhaust gas cleaning. The method and apparatus herein are subject to retrofit application on slot-type ovens converting coal to coke for metallurgical purposes wherein such ovens are subject to damage from misdirected water and steam.

20 Claims, 11 Drawing Figures

Fig. 1.
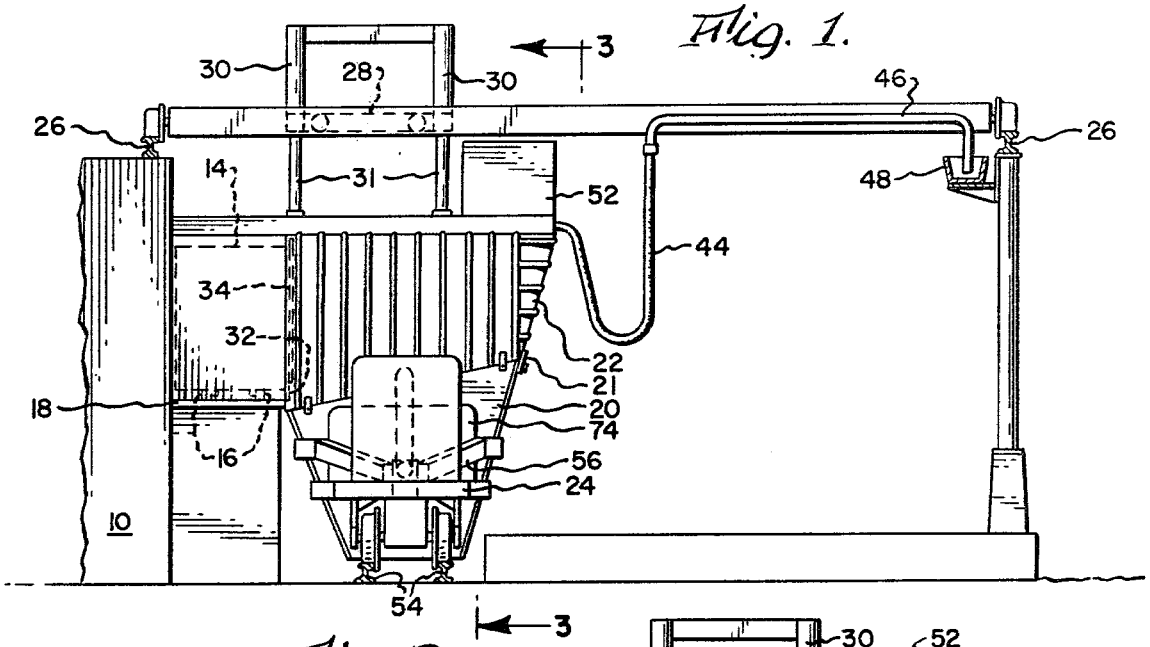
Fig. 2.
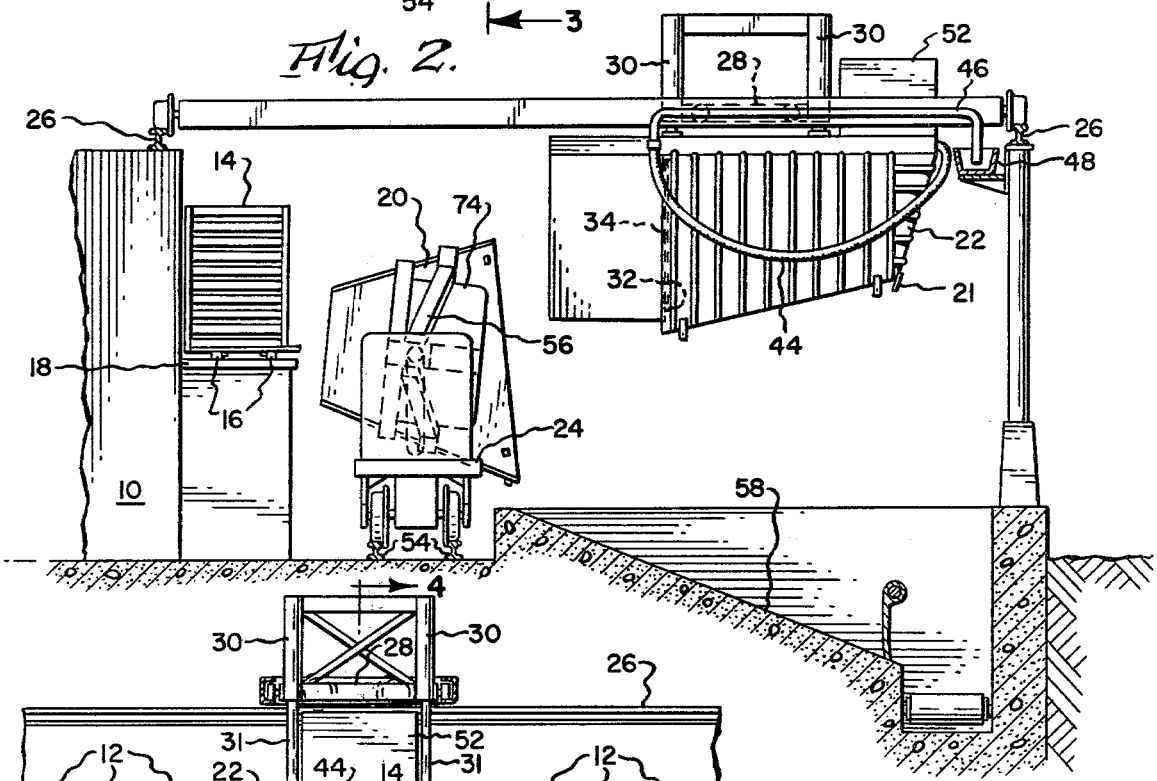
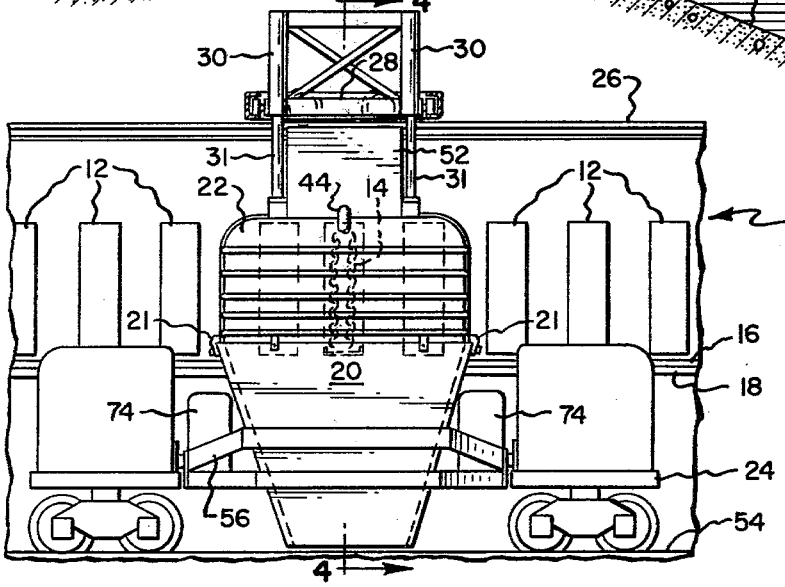
Fig. 3.

Fig. 4.
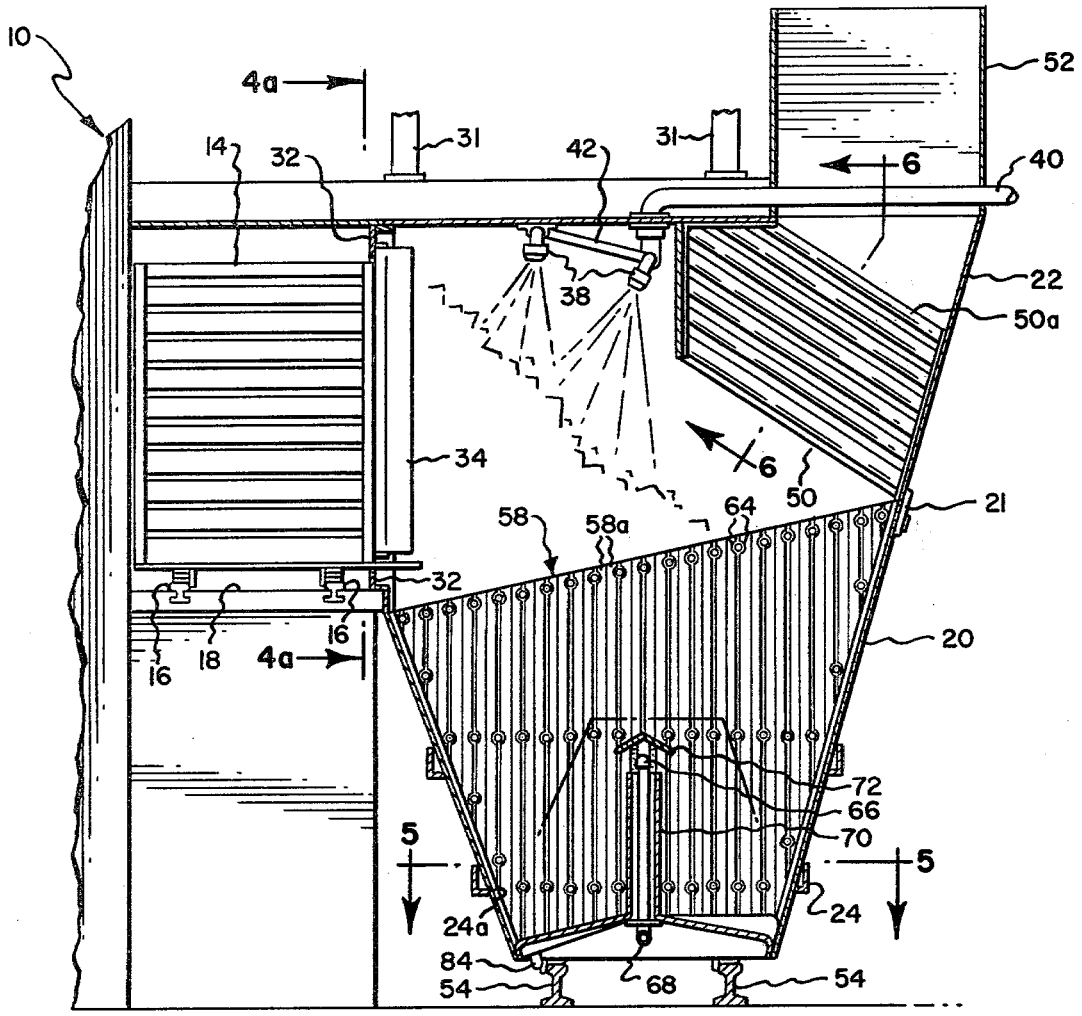
Fig. 4b.
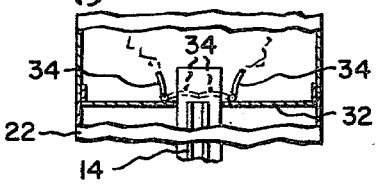
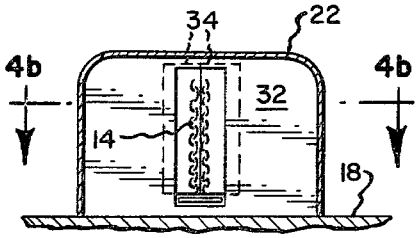
Fig. 4a.
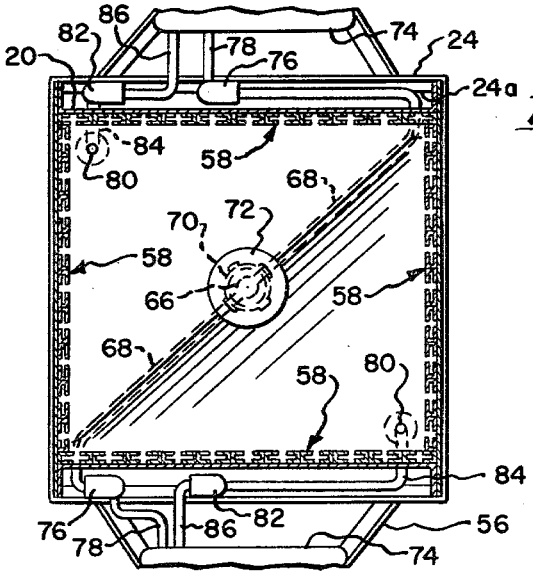
Fig. 5.

Fig. 6.
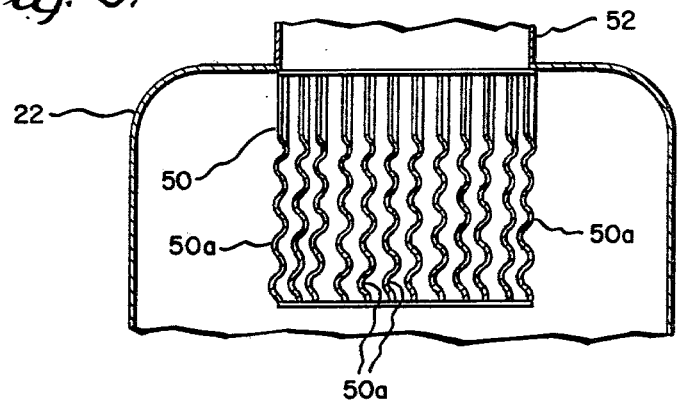
Fig. 7.
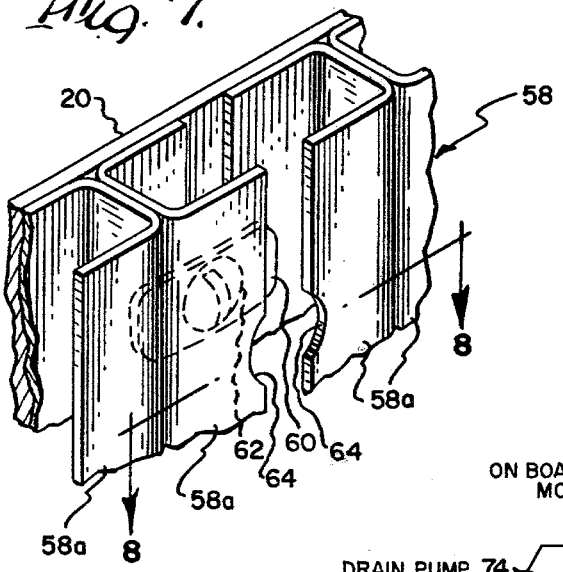
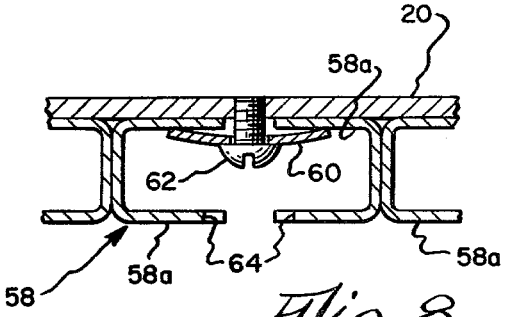
Fig. 8.
Fig. 9.
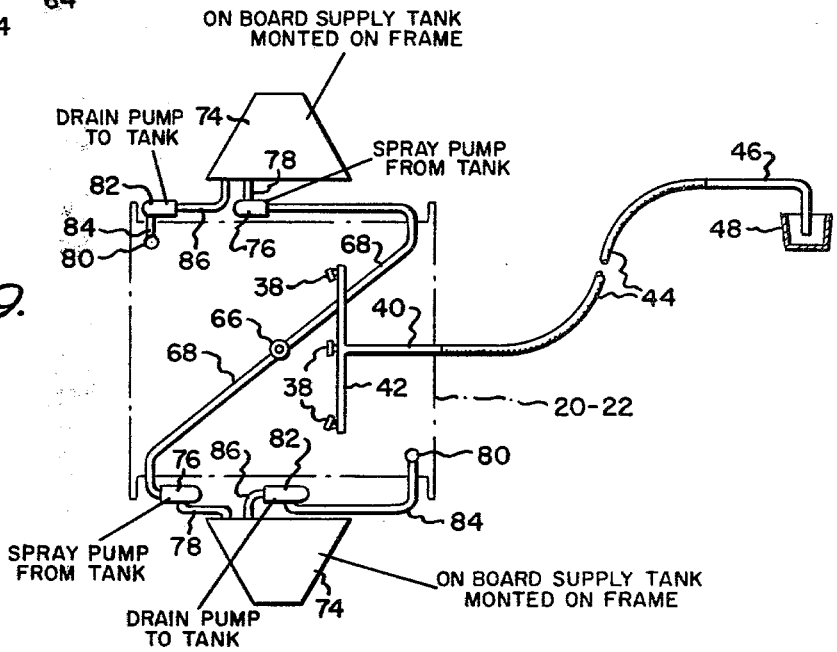

AIR POLLUTION CONTROL METHOD AND APPARATUS FOR THE EXTRUSION AND QUENCHING OF COKE

BACKGROUND OF THE INVENTION

The present invention relates generally to a method and apparatus for minimizing the emission of particulate-laden smoke to the ambient atmosphere during extrusion of incandescent coke from a coke oven and during the quenching thereof at oven side. More specifically, the present invention discloses a method and apparatus involving a "one spot" container and mating hood including a spraying system operable during extrusion and quenching of the coke. Particulate matter entrained in the resulting steam is removed upon passage of the steam through an inertial impaction vent disposed in the hood portion of the apparatus.

The ever-increasing concern over environmental pollution has focused on a number of industrial operations that emit substantial amounts of gases and particulate matter to the ambient atmosphere. Various gas-cleaning devices such as electrostatic precipitators, scrubbers, etc. have been employed to collect the emissions. However, such devices have generally been applicable for use only in conjunction with fixed or stationary capturing structures. Thus, there is a need for such systems that may be employed wherein vehicular operations are encountered, at least in part and which require emission control.

One particular industrial operation producing substantial gases and particulate emissions is the movement of incandescent coke from a slot oven and the conveyance of such incandescent coke to a remotely located quenching station at which the coke is quenched. Typically, coke is pushed or extruded from any one of several individual oven chambers in a slot-type battery into a movable guide by which the coke is constrained to fall into an open-top railroad vehicle while it is moving past a loading point adjacent to the coke oven. As the coke emerges from the oven, the gases and particulate emissions are relatively minor until the coke begins to break up as it leaves the coke guide to drop into the vehicle thereunderneath. This extruding and falling of the coke normally results in a generation of a substantial quantity of sooty smoke and other particulate matter of the type that pollute the ambient air and atmosphere.

Accordingly, in slot-oven cokemaking air polluting emissions escape during (1) the extrusion process, (2) while incandescent coke is transported to another location for quenching and during (3) quenching of the coke. Subsequent to quenching the cooled coke is discharged from the transiting equipment or vehicle associated therewith so that the same equipment can be used for subsequent cycles. All of the above steps are closely related because of the need to expeditiously handle incandescent coke once it is extruded to the atmosphere, where it begins to burn. The nature of these steps (and their punishing effect on equipment used therefor) are well known and normally repetitious through several cycles each hour. For example, a method and apparatus for controlling particulate emissions during the coke extrusion and transit phases referred to herein above is disclosed and claimed in applicant's U.S. Pat. No. 4,113,569, issued Sept. 12, 1978, and assigned to the assignee of the instant invention.

As considered in applicant's U.S. Pat. No. 4,113,569 water has most commonly been the media used to lower incandescent coke below its ignition temperature. It is well known to the art that some liquid water survives conversion to gaseous steam, even in the presence of excessive heat, because droplets of water or columns of water become covered with steam envelopes which diminish the transfer of heat. In traditional, remotely located quenching processes it is common to use three to four times as much water as is converted to steam, for example. Accordingly, the apparatus and process of the present invention include means for the collection and husbanding of water not converted to steam for reintroduction during subsequent cycles, and to do so without interfering with coke loading and unloading. All recycled water is moved by pumps on board the coke vehicle and reintroduced so as to minimize the known difficulty of quenching coke in the lower, central areas of a relatively deep container.

As considered herein above, traditional wet quenching has been conducted in remotely located towers with large, ground level portals to permit the entrance and exit of rail vehicles containing coke. In attempting to minimize the carryout of solids the steam plumes associated therewith are passed upwardly through inertial impactors to de-entrain water and particulate matter. The flow resistance of such de-entrainment facilities is necessarily kept minimal to minimize or avoid flow through the rail vehicle portals. The result has been marginally satisfactory emission control. In a fully closed apparatus as herein described the inertial impactors will intensify resistance to flow and enhance de-entrainment of water and particulates from exhausted steam.

As described above, air polluting emissions evolve from coke, both when a coke cake is breaking during the extrusion, and from the coke which has come to a position of repose within the container into which it is extruded. To facilitate containment of fume and to permit directing it through a gas cleaner it has been granted to be beneficial to hold the container immobile through the extrusion phase so that fume containing equipment having mating surfaces can directly contact with one another. This has led to the development of the concept of a "one-spot car" in which incandescent coke is contained in a relatively deep, short container. Rather than coke being disposed in a thin layer on the sloped bottom of a traditional long quench car, the newer concept causes problems in coke quenching and adaptations therefore must be incorporated. However, by obviating the time period necessary to move coke from where it is extruded to remote quenching facilities, one of the three hot coke emission periods is eliminated. The necessity to include apparatus devoted to control hot coke transit emissions is obviated along with interface adaptations with traditional or modified wet quenching facilities to accept the transiting car. Obviation of the time necessary for incandescent coke transit also permits lengthening and subduing the instantaneous intensity of the quenching process.

SUMMARY OF THE INVENTION

Accordingly, one object of the present invention is to provide an improved method and apparatus for effectively controlling air polluting emissions from incandescent coke during its initial extrusion from a slot-type oven and also during quenching thereof.

Another object of the present invention is to provide a method and apparatus for controlling the emissions described herein above which are operable with pre-existing coke processing facilities whereby a railroad type of vehicle is employed to index part of the apparatus comprising the instant invention to the various oven slots.

A still further object of the present invention is to provide the method and apparatus referred to herein above which may be employed in a reliable and economical manner without the need for excessive equipment and airhandling machinery. Along with avoiding the initial cost penalty associated with excessive size and complexity, energy consumption is minimized and the percentage of time in operation is maximized in the present invention.

Yet still another object of the present invention is to provide an apparatus for the purposes set forth above wherein excess water sprayed onto the coke and not converted to steam will be collected and recirculated into the reposing coke instead of being allowed to flow out into external collecting systems for treatment and use only in later cycles, if at all.

Still another object of the present invention is to provide an apparatus for the above purposes wherein the incursion of generated steam onto and into the coke oven brick work is prevented and whereby the formation of water gas is substantially avoided.

Another object of the present invention is to enhance the de-entrainment of particulates carried in the steam generated from the water sprayed on coke during both extrusion and quenching.

A further object of the present invention is to provide a "one-spot car" which avoids the problems associated with the prior art in capturing containment-escaping emissions.

In summary, the subject method and apparatus includes the provision of an enclosure over a coke guide and an adjacent coke admitting opening of a coke container. The enclosure has opposite sides generally parallel to the coke guide, inner and outer end wall generally parallel to the coke oven framing, and a top wall surmounting the side walls and end walls. The inner ends of the side walls and top wall may be positioned immediately adjacent to the coke oven framing in a smoke-tight manner so as to provide an enclosed atmosphere with respect to enveloped incandescent coke and steam. Spray nozzles are provided on the interior of the aforesaid enclosure for discharging water toward the coke as it is pushed from the oven and also as the coke reposes in an underlying container which mates with the enclosure as considered herein below.

The underlying container is generally in the form of an inverted, truncated pyramid which is cradled by the frame of a railway car similar to those for transporting hot metal. The container and cradled frame are pivoted about a horizontal axis on trunnions over the trucks of the car to discharge cooled coke onto a loading wharf remotely located from the oven in most instances.

By moving the car, the pivoted container is indexed in relation to a selected oven as is the overlying hood enclosure and associated coke guide, and is adapted to sealingly engage the overlying hood so as to form a smoke tight enclosure.

The hood includes an apertured inner end wall or bulkhead therein for allowing the extrusion of coke therethrough into the underlying container referred to herein above. During such extrusion phase, only a moderate amount of water is sprayed toward the coke by the hood spraying system as fully disclosed in applicant's U.S. Pat. No. 4,113,569. As described therein, parameters have been established for determining what constitutes an excessive or insufficient amount of water so as to control potential pollution by predetermined venting of resulting steam through a high differential impaction cleaner. Pressure within the hood enclosure can be allowed to elevate from atmospheric due to its mating engagement with the underlying container.

After the extrusion phase has been completed in a manner as contemplated in applicant's U.S. Pat. No. 4,113,569, the doors associated with the apertured inner end wall through which the coke is extruded are closed. At this point, the quenching phase commences. Water is sprayed onto the coke reposing in the coke container from overhead nozzles associated with the hood and a standpipe extending upwardly from the bottom of the container. The standpipe is centrally disposed within the mass of reposing coke so as to provide water recycling into the coke at such location.

The water sprayed from above the coke and recycled into the central portion of the coke mass generates an upward steam flow which passes through the vent in the hood wherein inertial impaction and high energy de-entrainment of the particulate matter wetted and carried by the steam is accomplished. As in the extrusion phase, the amount of water sprayed onto the reposing coke during the quenching phase is controlled so as to avoid a back pressure in the hood of more than two pounds psi. In this manner, a relatively longer period of time is necessary when compared to traditional quenching but since transmitting time to a remotely located quenching station is avoided, the total time required for quenching is about the same when compared to traditional quenching methods.

The inner surface of the pivoted or tiltable container is provided with a channelled liner which allows excess water to easily drain down the converging sides of the container into a drainage/storage tank system on the container framing for recycling into the coke. The channelled liner or skin on the container also provides an escape path for the upwardly rising steam. Since the steam is allowed to find a ready escape passageway, the formation of water gas is largely avoided by minimizing enduring contact of steam with incandescent coke.

At the end of the quenching phase, the hood is withdrawn from the container and the latter is elevated and conveyed by the transitting vehicle to a wharf. At the wharf the container is tilted to empty the coke.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a side elevation view of the hood apparatus and tiltable coke container of the present invention in association with a transitting vehicle through which the cradled container extends to rest on underlying tracks associated with the transitting vehicle during the extrusion and quenching phase;

FIG. 2 is a view similar to FIG. 1 with the hood disengaged and the coke container in an elevated, tilted condition for dumping coke onto a wharf;

FIG. 3 is an end elevational view of the hood apparatus in mated engagement with the underlying coke container as considered in FIG. 1;

FIG. 4 is an enlarged detailed view of the mated hood-container apparatus as taken about on 4—4 of FIG. 3;

FIG. 4A is a detailed view partly in section of the apertured inner end wall of the hood with the coke guide extending therethrough as taken about on line 4A—4A of FIG. 4;

FIG. 4B is a top view in section of the apertured inner end wall of the hood as taken about on line 4B—4B of FIG. 4A;

FIG. 5, partly in section is a plan view of the bottom of the coke container taken about on line 5—5 of FIG. 4;

FIG. 6 is a detailed view in section of the hood vent as taken about on line 6—6 of FIG. 4;

FIG. 7 is a perspective view in fragmentary form of the channelled liner attached to the inner surface of the coke container;

FIG. 8 is a top view in fragmentary section of said coke container liner as taken about on line 8—8 of FIG. 7; and FIG. 9 is a schematic view illustrating the arrangement of the plumbing associated with the liquid recycling system on board the coke container.

DETAILED DESCRIPTION OF A PREFERRED EMBODIMENT

Referring now in detail to FIG. 1, there is shown a coke oven battery generally indicated at 10 having a plurality of oven chambers 12 as shown in FIG. 3 extending transversely across battery 10 to the far side thereof and being separated from one another by intermediate cavity wall portions. A coke guide 14 is formed to include an upstanding tubular passage defined by oppositely disposed upstanding wall sections with overlapping, slotted sides. The coke guide 14 is movable longitudinally along the front of the coke oven on guide rails 16 which are more clearly seen in detail in FIG. 4. Tracks or rails are mounted on a bench or platform 18 which extends laterally outward from the several coke oven chambers.

As well known to those skilled in the art, an extractor device may be employed to move along tracks 16 and to periodically remove one of the doors from the several oven chambers 12 so that the coke masses may be extruded therefrom into the coke guide 14. Such an extrusion takes place by means of applying an extrusion force on the far longitudinal side of battery 10 toward the coke guide to accordingly push the coke therethrough, all of which is well known.

As stated, the coke ejected through the output end of the coke guide breaks off and falls downwardly from the bench 18 into an open-topped coke container 20 as seen most clearly in FIG. 4. As shown in FIGS. 1, 3 & 4, the hood enclosure 22, to be described in detail herein below, is adapted to be disposed in a locked, sealed engagement with the coke container 20.

The coke container 20 is mounted or carried in a transitting vehicle 24 for longitudinal movement along the coke oven front, independently of the parallel movement of the coke guide 14 and hood enclosure 22.

In considering the hood 22 in more detail, it is to be noted that the same may be moved along an overhead bridge trackway 26 to index it over the coke guide 14 prior to the latter receiving the ejected coke. In this regard, the hood 22 is moved laterally toward and away from the coke oven 10 by means of an overhead trolley 28. The hood 22 when superimposed over the coke guide 14 and coke container 20, may be lowered into locked, sealed engagement with the coke container 20. In this regard, the mechanical dogs 21 may be employed to lock the hood and container together. As considered more fully herein below, the weight of the container 20 precludes any tendency of the hood to lift off the container due to pressure in the hood. The lowering and raising of the hood 22 may be provided for example, by electrified screw jacks 30 which are operably connected to the hood.

The hood includes side walls parallel to the coke guide and an inner end wall 32 and corresponding outer end wall. All of these walls are surmounted and connected by a top wall.

The inner end wall 32 has an aperture therein which may be selectively opened and closed by a door means such as the pair of doors 34 as best seen in FIG. 4B. The opening in the inner end wall 32 is sized to receive the outer end of coke guide 14 when the hood is in a mated position with the container. The side wall portions of the coke guide which would otherwise extend beyond wall 32 are removed to allow opening and closing of doors 34 over the bottom of the coke guide which does extend beyond wall 32. As described herein below, inner end wall 32 and doors 34, when closed, function to protect an empty coke oven slot from steam generated during the quenching phase. The doors 34 are biased to be closed and are simply pushed open by the extruded coke. Necessarily other door arrangements could be employed. It is possible to carry the guide as an attachment to hood 22 and thereby minimize the span of bridge on trackway 26.

With respect to the positioning of the hood, it is to be understood that those skilled in the art could devise various apparatus to impart the desired movement to the hood. For purposes of the instant invention, it is only necessary that such positioning devices or apparatus be capable of maintaining the hood in smoke tight engagement with the coke oven 10 along the adjacent edges of the top wall and side walls of the hood and that the bottom edge portions of the hood be in smoke tight, uninterrupted engagement with the underlying top edge of the coke container 20.

As shown in FIG. 4, a plurality of water spraying nozzles 38 are disposed about the interior surfaces of the hood 22 in a location laterally spaced from the coke oven corresponding generally to the lateral spacing of the coke guide outlet end from the oven. As shown the nozzles 38 are fed by an input pipe 40 and inter-connecting pipes 42. Pipe 40 in turn is connected to a flexible hose 44 which is in turn connected to a supply pipe 46. The pipe includes a turned down suction end or submerged pump which is disposed in a longitudinally extending water trough 48. The water through 48 is continuously supplied or maintained with water at a predetermined level and by means of such trough the suction pipe 46 may be continually submerged therein regardless of which of the several positions the hood may be in along the longitudinal length of the trough. The flexible hose 44 of course provides for lateral movement of the hood 22 toward and away from the coke oven 10. As will be described in more detail herein below with respect to the operation of the hood apparatus and practice of the method herein, water is sprayed through nozzles 38 onto coke pushed through the coke guide 14 and furthermore recycled into coke reposing in the coke container 20 during the quenching phase.

In regard to the venting of the steam generated at modest pressure within the hood 22 during the extrusion and quenching phases, an impinger section 50 is surmounted by a stack 52. The impinger is provided at the outer edge of the hood opposite from the coke oven 10 at the base of stack 52. Relatively low pressure within hood 22 is sufficient to force exhausting flow through a comparatively high pressure drop (30" water to 50" water) impactor section 50 to provide highly efficacious particle de-entrainment. However, it is understood that efficacious gas cleaning could be accomplished by methods such as electrostatic precipitation instead of impaction, at the forced flow exhaust potential of modest hood steam pressure. The relative adjectives as regards pressure and pressure drop have meaning separate from one another. A gas cleaning device such as the impactor is considered to be a high energy (high pressure drop) system at 30" water or more, whereas steam pressure which is capable of overcoming such resistance is still very low at 30" water or little more than a pound pressure.

Turning now to a detailed consideration of the coke container 20, it is to be noted that the same is generally in the form of an inverted, truncated pyramid with upwardly diverging walls. The coke container is carried by a railway type of vehicle 24, which as stated is similar to those used to contain molten metal as is well known to those skilled in the art. The vehicle 24 moves longitudinally along the side of the coke oven 10 on tracks 54 for purposes of aligning or indexing the coke container 20 with one of the various oven slots and the coke guide 14 aligned or indexed therewith. The coke container 20 may extend downwardly through an opening 24*a* in the frame of the vehicle 24 so as to rest on the tracks 54 during the coke extrusion and quenching phases. The coke container 20 is attached to vehicle 24 by a trunnion arrangement generally indicated as 56 in FIGS. 1–3. In this regard, the trunnion arrangement 56 functions to move or elevate the coke container 20 from a position at rest on tracks 54 to a raised position for translational movement and tilting as shown in FIG. 2 (subsequent to quenching) wherein the quenched coke may be dumped on a wharf 58 on the side of the track remote from the oven in most instances.

The inner sides of the coke container 20 include an expendable liner or contact surface 58. The expendable contact surface 58 is in the form of adjacent pairs of U-shaped channels 58*a* which face one another in a spaced relationship as shown in detail in FIG. 8. Corresponding legs of the channels 58*a* are mounted in flush engagement against the inner wall surface of the coke container 20. The channel legs are so mounted by means of a resiliently arched bracket 60 and a threaded bolt means 62 which engages the wall of the container 20. At selected locations, the outer leg portions of channels 58*a* include corresponding cutouts 64 for insertion of a tool to engage and disengage the bolt 62 and associated mounting bracket 60 whereby the various channels 58*a* may be easily assembled in the first instance and replaced at a later point in time as necessary. The container also may be disconnected, removed and replaced within the supporting frame.

As described in detail herein below, the channel members 58*a* provide a contact surface for the incandescent coke and thereby protect to a certain extent the main wall portion of the coke container 20. Although the channel elements 58*a* will experience a certain degree of warping over a period of time, they are expendable and may be easily replaced. In addition, as described below, the vertical passage ways defined by the channel members provide a drain for water sprayed on the extruded and reposing coke and also provide a path for the escape of steam generated particularly during the quenching phase.

As viewed in FIG. 4, the bottom of the coke container 20 supports an upstanding standpipe 66 which is supplied by a feed conduit 68. Standpipe 66 functions to recycle water into the central portion of a mass of coke reposing in container 20.

The vehicle includes a pair of on-board supply tanks and drainage system with respect to providing water to standpipe 66 and recirculating all water which is not converted to steam during the extrusion and quenching phases. As shown in FIGS. 5 and 9, each side of coke container 20 is connected to the on-board water recycle tank 74 mounted on the frame associated with the coke container. Each water recycle tank 74 communicates with a recycle pump 76 through a conduit 78. Each recycle pump 76 in turn supplies the diagonally oriented conduit 68 and the upstanding standpipe 66.

As shown in FIGS. 4 and 5, the bottom of the coke container 10 includes a diagonal ridge which overlies the conduit 68. In this arrangement water draining onto the bottom of the coke box and from the channel member 58 flows to the diagonally disposed drains 80 in the bottom corners of the coke container. Such drainage water is pumped into the recycle tanks 74 by drain pumps 82 through conduits 84 and 86.

The drain and recycle pumps 76 and 82 are of a slurry type, preferably since the water most likely will include a substantial amount of particulate matter. Furthermore, in the preferred embodiment, only one recycle pump 76 may be operable at any given time for purposes of pumping water through standpipe 66. Lastly, since the recycle tanks 74 and associated pumps and conduits are integrally attached to the container cradling frame, the recycle tanks 74 and conduits 84 and 86 are so designed that stored water does not drain out during tilting of the coke container 20 as shown in FIG. 2 without benefit of shutoff valves.

In describing in detail the operation of the apparatus and method of the instant invention a number of fundamental points are to be noted so as to better illustrate such operational details. As stated previously, the subject matter of the instant invention concerns the quenching of coke with low residual coke moisture prior to movement from the point where extrusion takes place. It is conceivable that the steam generated in this invention could be utilized as energy in a process other than the subject process if at a suitable elevated temperature (250° to 500° ) and pressure (100+ psi). In regard to the inventive process the energy in the steam is not collected at a pressure or temperature suitable for energy for other than the subject process.

In contrast, the high differential gas cleaner included in the vent of the hood in the instant invention is traversed as a result of internal pressures from steam generation on the order of a maximum of 2 psi. Accordingly, the steam pressures generated in operating the apparatus and employing the method of the instant invention intentionally avoid internal pressures in excess of 2 psi so as to protect the apparatus during use. The method employed in the instant invention does not involve subjecting the coke to prolonged contact with steam and, in fact, avoids such conditions as those which would foster generation of hydrogen (water gas) by allowing the steam to swiftly escape from proximity with the incandescent coke.

An important point to be recognized is that, particularly during the quenching phase, water passing through the coke does not completely turn to steam even though excess heat may be available in the coke. This phenomenon is well recognized in the industry as is the fact that a corresponding need for excess water exists so as to quench the coke. Accordingly, the apparatus of the instant invention includes means for reusing and recycling quenching water repeatedly until it is exhausted as steam or periodically drained with settled wet coke fines.

In describing the operation of the present invention, such description will be with respect to a breaking cake of incandescent coke as normally extruded from a coke oven chamber 12. Individual ovens 12 in a coke oven battery 10 may be extruded 4 to 6 times per hour and each extrusion or "push" requires on the order of 35 to 40 seconds. At the time of the extrusion there is created an intense thermal updraft due to the heat of the coke which in turn carries with it particulate matter associated with the coke. The upward rise of the particulate-laden plume is mechanically thwarted initially by the physical confinement of hood 22. In addition to the thermal updraft just described, breaking of the coke cake at the end of guide 14 has been known to include the exposure to atmospere of uncarbonized volatile matter known as "greenness" in the coke which normally results in partial, uncontrolled combustion of such volatile matter. This condition of greenness is most often indigenous to batteries which have been in operation for a relatively large portion of their operating lifetimes as is well known to those in the coke industry. The spraying of the coke therefore during extrusion in a predetermined manner by nozzles 38 is directed to both a suppression of combustion of the coke cake on its initial extrusion from a coke oven chamber and during a period of time until the quenching phase commences. The spraying of the coke during the extrusion phase is fully described in applicant's U.S. Pat. No. 4,113,569 and applies herein in the same manner.

Although the initial thermal updraft and particulate matter entrained therein is prevented from passing directly to the atmosphere by the mechanical assembly of the hood 22, the impinger section 50 and stack 52 do provide for internal pressure release with respect to the hood as will more clearly appear herein below, but only after substantially suppressing the amount of particulate matter which would otherwise pass to atmosphere.

As described in applicant's U.S. patent referred to herein above the water sprayed on the coke as it passes through the coke guide is of a limited quantity so as to insure suppression of combustion within the hood apparatus. Accordingly it is to be understood that the introduction of water within the hood apparatus during coke extrusion is not a quenching process but only a combustion suppression process. Quenching of the coke immediately subsequent to the extrusion process is a distinctly separate phase as considered herein below.

Upon the sprayed water within the hood absorbing heat from the incandescent coke as it passes from a coke oven chamber, the resultant steam immediately creates an enveloping atmosphere within the environment defined by the hood 22 and coke container 20 which necessarily mixes with or absorbs the thermal updraft created by the intense heat of the coke. Steam is substantially precluded from flowing to the coke oven or coke oven slot by the hood inner end wall 32 and the existence of coke in the coke guide 14. It is in this regard that it is preferred that the doors 34 be biased toward a closed disposition, subject to being pushed open by the extruded coke, so as to minimize any leakage of steam from the hood. The resultant steam atmosphere developed in the hood during extrusion tends to preclude any potential combustion of the moving coke within the hood. Further, the enveloping steam atmosphere protects the hood itself from the heat radiating from the moving coke since the steam functions as a highly efficient radiant heat absorber. The protection of the hood from such radiant heat is to be distinguished from the evaporation of the sprayed water which absorbs the sensible heat from the surface of the coke.

In regard to the venting of the steam atmosphere within the hood through the impinger section 50 and stack 52 referred to herein above, during both extrusion and quenching, it has been found more effective to position the impinger 50 and stack 52 in the top wall of the hood 22 at the outer edge thereof opposite from the coke oven.

In this regard, quench water may be sprayed on the reposing coke mass in container 20 through nozzles 38 and the water supply system associated therewith. In addition, one or both of the on-board recycle tanks 74 and associated recycle pumps 76 may supply standpipe 66 to inject water into the center of the reposing coke mass. As indicated above, steam will be generated throughout the coke mass and will flow upwardly and outwardly to pass through impinger 50. Quench water which is not converted to steam readily flows to the bottom of the coke container through the channel members 58 for pumping into the recycle tanks 74 for reintroduction to the coke. The channel members 58 also facilitate the flow of steam upwardly to duct 50. At all times, the quenching rate is controlled so as to prevent a pressure build-up in the hood above for example 2 psi so as to protect the integrity of the hood. It is to be further noted that the channel members 58 may experience substantial warping after a period of use due to the intense heat from the coke. However, the channel members 58 may be readily replaced as considered herein above while protecting the outer wall surface of the coke container from direct contact with the coke. The whole container can be removed and replaced as a component of the vehicle.

During the extrusion phase, an amount of water on the order of 500 gallons may be sprayed onto the coke by nozzles 38, a substantial portion of such water being converted to steam in a controlled manner as fully described in applicant's related U.S. Pat. No. 4,113,569. During the quenching phase, another 1,000–2,000 gallons of water will be sprayed on the coke through the operation of nozzles 38 and repeatedly recycled through standpipe 66, the latter being significant during the quenching phase. While traditional quenching at a remote station may take on the order of 3 minutes, quenching in the instant invention takes longer than 3 minutes in view of the controlled rate at which quench water is applied. However, since transitting time a remote quench station is being saved, the total time to quench the coke and dump the same on a wharf would be approximately the same as in prior art methods—i.e. on the order of 7 minutes.

The manner of de-entrainment of particulate matter from the steam flow through impinger section 50 is of equal, enhanced efficacy during both the extrusion and quenching phases.

At the conclusion of the quenching phase, the hood 22 is unlocked from the container and is elevated for lateral indexing on another oven. Also, the trunnion mounting arrangement 56 for the coke container may be activated, in a remote manner for example, so as to elevate the coke container off of the tracks 54. Should a wharf be remotely located from the coke oven, transitting vehicle 24 could convey the coke container, in an elevated condition, to a remotely locationed wharf at which the container 20 could then be tilted to dump the coke. Should a dumping wharf 58 be available at the side of the coke oven as in FIG. 2, the coke container would be tilted on the order of 90° from its elevated disposition whereby the downwardly sloping sidewall of the coke box allows the coke to tumble onto the wharf.

The generation of steam during the extrusion and quenching phases continuously urges the steam to flow through the impinger section 50 whereby the hood 22 may self-exhaust. Indeed, it is considered that any externally energized induced draft exhaust would tend to reduce the efficacy of the method described herein.

From the foregoing, it is apparent that the objects of the present invention have been fully accomplished. As a result of this invention, a method and apparatus are provided for extruding and quenching coke in "one spot." The apparatus into which the coke is extruded and in which it is quenched in turn is adapted to dump the coke directly onto a wharf facility. The apparatus of the instant invention includes a circulation system for reintroducing excess extrusion and quenching spray water onto the coke. In addition, the coke oven facility is protected against steam incursion during the extrusion and quenching phases.

Having thus described and illustrated my invention, it will be understood that such description and illustration is by way of example only and such modifications and changes as may suggest themselves to those skilled in the art are intended to fall within the scope of the present invention as limited only by the appended claims.

I claim:

1. In a method for controlling air pollution associated with a coke oven having a plurality of oven chambers adapted to process a corresponding plurality of coke masses and wherein hot coke masses are ejected from said oven chambers through an inlet end of a coke guide and through an outlet end thereof laterally spaced from said coke oven, the improvement comprising the steps of:

providing a vehicle means selectively movable past said oven chambers for indexing with said coke guide and carrying an open topped coke receiving container tiltable about a horizontal axis, providing a hood to enclose within said hood in a substantially smoketight manner the air space over said container, mating said hood with said container when in registry with one another, extruding coke through said coke guide into said container while immobile, when one is indexed to the other, spraying the coke upon passage through said coke guide to said container with a predetermined quantity of liquid insufficient to quench the coke but sufficient to create a vapor atmosphere within said enclosed air space whereby particulate matter within said air space associated with the coke becomes wetted and entrained in said vapor and combustion of said coke in said air space is substantially retarded, providing a restricted passage through said hood from said air space to ambient atmosphere for venting of said vapor and particulate matter entrained therein, said passage ncluding means to preclude open venting to ambient atmosphere whereby a back pressure of vapor is developed in said hood, providing means responsive to said back pressure in said hood for removing said wetted, entrained particulate matter from the vapor flow through said passage.

2. The method according to claim 1 including the further step of spraying the coke while reposing in said container with a predetermined quantity of liquid to maintain substantially a vapor atmosphere within said hood and to reduce the temperature of the coke down to a pre-selected temperature range whereby the coke becomes quenched.

3. The method according to claim 2 wherein liquid is sprayed on the reposing coke during quenching thereof at a rate such that the resulting vapor pressure does not exceed 2 psi within said hood.

4. The method according to claim 2 including the further step of introducing liquid into the central portion of the coke reposing in said container.

5. The method according to claim 1 including the step of providing drainage for liquid in said container and air escape passageway for steam generated within said container whereby said container is cooled.

6. The method according to claim 5 including the further step of reintroducing liquid drainage into the central portion of the coke reposing in said container whereby particulate matter carried by said liquid drainage so reintroduced is filtered out by the coke reposing in said container.

7. The method according to claim 1 wherein the back pressure of vapor developed in said hood is maintained at a sufficiently reduced level that said vapor does not experience such acceleration upon venting through said restricted passage whereby its opaqueness would be lost.

8. In a coke air pollution control system for a coke oven having a plurality of oven chambers, the combination comprising:

vehicle means selectively movable past said oven chambers, said vehicle carrying an open topped coke receiving container tiltable about a horizontal axis whereby said container may be indexed to said oven chambers for the reception of coke extruded therefor while immobilized, a coke guide having an inlet end adapted to receive a coke mass extruded from any of said oven chambers, when indexed therewith, and an outlet end laterally spaced from said coke oven for guiding extruded coke mass to fall into said coke receiving container when indexed therewith, a hood apparatus selectively positioned above said coke receiving container, said hood apparatus comprising a top wall, oppositely disposed side walls and inner and outer end walls, said walls being connected together to envelope said coke guide and said coke receiving container, said hood being supported to maintain it in a substantially smoketight manner with said coke oven and said side walls and end walls of said hood correspondingly mating with said open top of said container in a substantially tight manner to inhibit the loss of smoke and pressure therebetween, said inner end wall of said hood defining a coke guide opening through which said coke guide extends, said hood further including liquid spraying means mounted on the interior surface thereof, supply means for supplying said spraying means with a liquid for the spraying thereof in predetermined quantities toward the coke as it is extruded and as it reposes in said coke container to thereby create substantially a vapor pressurized atmosphere within said hood and to reduce the temperature of the coke down to a preselected temperature range whereby the coke is quenched, said supply means supplying said liquid in quantities so that the vapor atmosphere does not exceed a predetermined maximum pressure level whereby particulate matter within said air space associated with said coke becomes wetted and entrained in said vapor, and an exhaust gas cleaning section in said hood for venting said vapor and particulate matter entrained therein, said gas cleaning section including means for deentraining and removing wetted, particulate matter from the vapor flow through said exhaust opening.

9. The combination according to claim 8 where said gas cleaning means is a section of impinger plates for deentraining wetted particulates from the vapor exhaust flow.

10. The combination according to claim 1 wherein said coke receiving container is generally in the form of an inverted, truncated pyramid.

11. The combination according to claim 1 wherein said vehicle means comprises a railway type of vehicle having trunnion means for tilting said container to a sufficient degree so as to empty contained coke therefrom.

12. The combination according to claim 1 including locking means for locking said hood to said container whereby said container anchors said hood to resist any uplift which might otherwise occur due to pressure within said hood.

13. The combination according to claim 1 wherein said spraying means is adapted to spray liquid at a sufficient rate for a sufficient period of time onto coke reposing in said containers so as to quench the coke.

14. The combination according to claim 1 wherein said coke receiving container includes a drainage and recirculation system for recycling liquid not converted to steam onto the coke.

15. The combination according to claim 14 wherein said recirculation system includes means for storing liquid drainage and recycling liquid drainage at different rates.

16. The combination according to claim 1 wherein the inner surface of said coke receiving container includes a vertically channelled liner affixed thereto, said vertically channelled liner having openings whereby sprayed liquid not converted to vapor may drain downwardly therethrough and wherein steam may flow upwardly to pass through said exhaust duct opening in said hood.

17. The combination according to claim 1 wherein the bottom of said coke receiving container includes a diagonally extending elevated ridge whereby those portions of the bottom wall of said container on opposite sides of said ridge drain to correspondingly opposite corner of said container wherein said opposite bottom corners of said container include drainage means.

18. The combination according to claim 1 including door means openable with respect to the aperture in said inner end wall of said hood and the portion of said coke guide projecting therethrough for closing off the interior of said hood from open communication through the aperture in said inner end wall with the refractory oven subject to steam damage.

19. The combination according to claim 1 wherein said coke receiving container includes liquid recycle means mounted on the interior surface thereof for delivering liquid to the coke reposing in said coke receiving container, and supply means for supplying said recycle means in said coke receiving container with a liquid for the recycle thereof in predetermined quantities.

20. The combination according to claim 19 wherein said recycle means is adapted to deliver liquid into the central portion of coke reposing in said container.

* * * * *

UNITED STATES PATENT AND TRADEMARK OFFICE

CERTIFICATE OF CORRECTION

PATENT NO. : 4,274,923

DATED : June 23, 1981

INVENTOR(S) : Mahar

It is certified that error appears in the above—identified patent and that said Letters Patent is hereby corrected as shown below:

Column 13, line 1 of Claim 10, delete the numeral "1" and insert the numeral -- 8 --.
Column 13, line 1 of Claim 11, delete the numeral "1" and insert the numeral -- 8 --.
Column 13, line 1 of Claim 12, delete the numeral "1" and insert the numeral -- 8 --.
Column 14, line 1 of Claim 13, delete the numeral "1" and insert the numeral -- 8 --.

Column 14, line 1 of Claim 14, delete the numeral "1" and insert the numeral -- 8 --.
Column 14, line 1 of Claim 16, delete the numeral "1" and insert the numeral -- 8 --.
Column 14, line 1 of Claim 17, delete the numeral "1" and insert the numeral -- 8 --.
Column 14, line 6 of Claim 17, delete "corner" and insert -- corners --.
Column 14, line 1 of Claim 18, delete the numeral "1" and insert the numeral -- 8 --.
Column 14, line 1 of Claim 19, delete the numeral "1" and insert the numeral -- 8 --.

Signed and Sealed this

*Twelfth* Day of *January 1982*

[SEAL]

*Attest:*

GERALD J. MOSSINGHOFF

*Attesting Officer*

*Commissioner of Patents and Trademarks*